US005204233A

United States Patent [19]

Ogasawara et al.

[11] Patent Number: 5,204,233

[45] Date of Patent: Apr. 20, 1993

[54] PHOTOGRAPHIC SILVER HALIDE ELEMENT HAVING COATED PARTICLES

[75] Inventors: Akira Ogasawara; Takeo Arai, both of Hino, Japan

[73] Assignee: Konica Corporation, Tokyo, Japan

[21] Appl. No.: 772,230

[22] Filed: Oct. 7, 1991

[30] Foreign Application Priority Data

Oct. 9, 1990 [JP] Japan ..... 2-270704
Feb. 13, 1991 [JP] Japan ..... 2-19977

[51] Int. Cl.[5] ..... G03C 1/76

[52] U.S. Cl. ..... 430/523; 430/539; 430/950

[58] Field of Search ..... 430/525, 950, 961, 539

[56] References Cited

U.S. PATENT DOCUMENTS 4,562,140 12/1985 Kohmura et al. ..... 430/950
4,610,924 9/1986 Tamagawa et al. ..... 437/950
4,675,278 6/1987 Sugimoto et al. ..... 430/950
4,725,526 2/1988 Frass et al. ..... 430/950
4,777,113 10/1988 Inoue et al. ..... 430/950
4,975,363 12/1990 Cavallo et al. ..... 430/950

*Primary Examiner*—Jack P. Brammer
*Attorney, Agent, or Firm*—Finnegan, Henderson, Farabow, Garrett & Dunner

[57] ABSTRACT

A plastic film or coated paper has a hydrophilic colloid layer thereon comprising particles with the average particle size of 0.5 to 20μ coated with a water-repellent material. The water-repellent material is selected from the group consisting of silicone, a silane compound, a fluorine-containing compound and a silane coupling agent. A silver halide photographic light-sensitive material comprises a hydrophilic colloid layer comprising particles with the average particle size of 0.5 to 20μ coated with a water-repellent material.

3 Claims, No Drawings

PHOTOGRAPHIC SILVER HALIDE ELEMENT HAVING COATED PARTICLES

FIELD OF THE INVENTION

The present invention relates to a plastic film or coated paper which is used in the roll form or with its surface plane in close contact with other material, and also relates to a silver halide photographic light-sensitive material having an excellent surface-mattedness.

BACKGROUND OF THE INVENTION

A material in the film form such as a plastic film or coated paper has its surface matted by adding a matting agent thereto for the purpose of preventing its blocking that possibly occurs when wound up in the roll form or improving the close vacuum adhesion property and slidability of it when its entire surface plane is brought into contact with other material. The addition of a matting agent is carried out by coating a hydrophilic colloid layer containing the agent on a support.

Known as the above matting agent are the silica described in Swiss Patent No. 330,158; the glass powder described in French Patent No. 1,296,995; the inorganic particles such as of carbonates of alkaline earth metals, cadmium and zinc described in British Patent No. 1,173,181; the starch derivatives described in Belgian Patent No. 625,451 and British Patent No. 981,198: the polyvinyl alcohol described in JP E.P. No. 3643/1969: the polystyrene or polymethyl methacrylate described in Swiss Patent No. 330,158; the polyacrylonitrile described in U.S. Pat. No. 3,079,257; and the organic particles such as of polycarbonate described in U.S. Pat. No. 3,022,169.

Where such matting agent particles are suspended in a hydrophilic colloid layer, the matting agent is liable to sink in the hydrophilic colloid layer during the coating/drying process, so that it is difficult to obtain a sufficient mattedness. If a large amount of a matting agent or a large particle-size-having matting agent is used in order to increase the mattedness, there possibly occurs deterioration of haze or trouble by foreign matter. Especially in a silver halide photographic light-sensitive material (hereinafter merely called light-sensitive material) having a plurality of hydrophilic colloid layers, some of matting agent particles come out of the surface layer and reach the image-forming layer to thereby cause pinhole trouble. If, to avoid this phenomenon, the amount of gelatin as the hydrophilic colloid is reduced, the pinhole trouble becomes more conspicuous, which is a drawback to the improvement of the hygroscopic expansion characteristic of the hydrophilic colloid layer.

U.S. Pat. No. 4,920,004 discloses that matting agent particles whose surface is grafted with gelatin less sink to the lower layer and not exfoliate even after being processed. However, a light-sensitive material in which such the matting agent particles are used has the disadvantage that it shows a conspicuous blocking trouble when wound up in the roll form.

SUMMARY OF THE INVENTION

It is an object of the invention to provide a plastic film, coated paper or light-sensitive material which is improved in the antiblocking property as well as in the mattedness by using a matting agent which scarcely sinks and has a high matting efficiency when added to a hydrophilic colloid layer and is strongly bounded to the surface of the layer.

It is another object of the invention to provide a light-sensitive material having a high mattedness and few or no pin-holes attributable to a matting agent.

It is a further object of the invention to provide a light-sensitive material having a low hygroscopic expansion property.

The above objects of the invention can be accomplished by a plastic film or coated paper having a hydrophilic colloid layer thereon comprising particles with an average particle size of 0.5 to 20μ coated with a water-repellent material, or a silver halide photographic light-sensitive material comprising a hydrophilic colloid layer comprising particles with an average particle size of 0.5 to 20μ coated with a water-repellent material.

DETAILED DESCRIPTION OF THE INVENTION

In the invention, the grains coated with the water-repellent material of the invention are called the nuclei of a matting agent. As the nuclei of the matting agent of the invention there may be used any conventionally known matting agent: it is preferably one having a low bulk specific gravity, and more preferably amorphous silica. In addition, porous zeolite, silica alumina and rare earth oxides are also suitably usable. A polymeric organic substance such as polymethyl methacrylate, polystyrene, polyimide or a copolymer thereof may be used as well; it is preferably one made porous like an aerogel, and its bulk specific gravity is preferably not more than 1.5, and more preferably not more than 1. In order to lessen the bulk specific gravity, amorphous particles are preferred, but figurate particles such as spherical particles may also be used. Besides, hollow particles may be used as well.

The average particle size of such particles is preferably 0.5 to 20μ. and more preferably 1 to 15μ. The adding amount of the particles is preferably 1 to 150mg/m$^2$, and more preferably 1 to 100 mg/m$^2$.

The water-repellent material used for coating the surface of the nuclei of the matting agent is preferably silicone, a silane compound, a fluorine-containing compound or a silane coupling agent, and more preferably, a silane coupling agent. Examples of the above material are explained below:

Examples of the silane compound include methyltrimethoxysilane, trimethylchlorosilane, dimethyldichlorosilane, methyltrichlorosilane and trimethylfluorosilane.

Examples of the silicone include dimethylsilicone oil, and fluorinated, alkylated, epoxidated, polyetherified and aminated silicone oils.

Examples of the fluorine-containing compound include polyethylene tetrafluoride, polyethylene trifluoride, polyvinylidene fluoride; the copolymers thereof with acrylic acid, methacrylic acid and derivatives thereof; and fluorine-substituted alkyl, alkoxy and silane compounds.

Examples of the silane-coupling agent include

A-1 Vinyltrichlorosilane,
A-2 Vinyltriethoxysilane,
A-3 γ-chloropropyltrimethoxysilane,
A-4 γ-chloropropylmethyldichlorosilane,
A-5 γ-chloropropylmethyldimethoxysilane,
A-6 γ-chloropropylmethyldiethoxysilane,
A-7 γ-aminopropyltriethoxysilane,
A-8 N-(β-aminoethyl)-γ-aminopropyltrimethoxysilane, A-9 N-(β-aminoethyl)-γ-aminopropylmethyldimethoxysilane,
A-10 γ-mercaptopropyltrimethoxysilane,
A-11 γ-glycidoxypropyltrimethoxysilane,
A-12 γ-glycidoxypropylmethyldimethoxysilane,
A-13 γ-methacryloxypropyltrimethoxysilane,
A-14 γ-methacryloxypropylmethyldimethoxysilane,
A-15 Di-(γ-methacryloxypropyl)-dimethoxysilane,
A-16 Divinyldiethoxysilane,
A-17 Di-(γ-aminopropyl)-diethoxysilane, and
A-18 Di-(γ-glycidoxypropyl)-dimethoxysilane.

There are various coating methods. In the invention, the methods are explained separately for organic materials and inorganic materials.

1. Surface Treatment to Organic Material Particles

For the purpose of improving the mechanical strength, electrical characteristics, water resistance and adhesion property of organic matting agent particles, to the particles or a mixture thereof with inorganic particles is added a 0.2 to 2% silane-coupling agent directly or in the form of a solvent solution.

2. Surface Treatment to inorganic material particles

Inorganic material particles are subjected to surface treatment for the purpose of improving the mechanical strength, electrical characteristics, water resistance and adhesion property thereof when mixed with an organic material. There are the following methods therefor.

a. Dry process

A silane-coupling agent in the form of an aqueous or solvent solution or without dilution is sprayed or added dropwise to inorganic material particles (inorganic filler) being well stirred in a Henshel mixer, super mixer or V-blender. For uniformly dispersing the silane-coupling agent, the agent is used preferably in the form of aqueous solution or alcohol/water solution.

b. Wet process

Inorganic material particles (inorganic filler) are dispersed in water and rapidly stirred to be slurried, and the slurry, after adding an aqueous silane-coupling agent solution thereto, is stirred and then allowed to stand to let the particles settle. After the sedimentation of the inorganic material (inorganic filler), the supernatant is decanted off, and the residuum is then dried.

c. Spray process

An aqueous silane-coupling agent solution is sprayed to inorganic material particles (inorganic filler) at a high temperature.

The addition of a matting agent to the light-sensitive material may be performed either by coating a layer-coating liquid in which is dispersed the matting agent beforehand or by spraying the matting agent onto a coated layer before completion of the drying thereof. In the case of adding a plurality of different matting agents, both methods may be used in combination. Techniques for more effectively adding such matting agents to the light-sensitive material are described in Patent Application No. 228762/1989.

As the hydrophilic colloid, gelatin is particularly useful, but it may be used in combination with other hydrophilic colloid materials such as gelatin derivatives, cellulose derivatives, graft polymers of gelatin and other high-molecular materials, other proteins, sugar derivatives and synthetic aqueous homo- or copolymers.

As gelatin there may be used lime-treated gelatin, acid-treated gelatin, the oxygen-treated gelatin described in Bull. Soc. Sci. Phot. Japan, No. 16, p.30, and hydrolyzed or enzymedecomposed gelatin. The above gelatin derivatives include those obtained by the reaction of gelatin with various compounds such as acid halides, acid anhydrides, isocyanates, bromoacetic acid, alkanesultones, vinylsulfonamides, maleic imide compounds, polyalkylene oxides and epoxy compounds, and particular examples thereof are described in U.S. Pat. Nos. 2,614,928, 3,132,945, 3,186,846 and 3,312,553; British Patent Nos. 861,414, 1,033,189 and 1,005,784; and JP E.P. No. 2684/1967.

The above proteins include albumin and casein. The cellulose derivatives include hydroxyethyl cellulose, carboxymethyl cellulose and cellulose sulfate. The sugar derivatives include sodium alginate and starch derivatives.

Usable as the above graft polymers of gelatin and other high molecular materials are preferably those obtained by grafting homo- or copolymers comprising vinyl monomers such as acrylic acid, methacrylic acid, esters of these acids, amido derivatives, acrylonitrile and styrene into gelatin: the particularly preferred are gelatin-graft polymers comprising polymers compatible to a certain extent with gelatin, such as acrylic acid, acrylamide, methacrylamide and hydroxyalkyl methacrylate. Examples thereof are described in U.S. Pat. Nos. 2,763,625, 2,831,767 and 2,956,884.

As the support there may be used any materials without restriction, which include plastics such as polyethylene terephthalate, cellulose triacetate, polycarbonate, polyimide, nylon, polyvinyl and polyvinylidene chloride; polyolefin-coated paper; and hydrophilic colloid layer-coated paper. On the support may be provided a subbing layer in order to increase its adhesion property to a hydrophilic colloid layer. Examples of the subbing layer include the subbing layer prepared in an organic solvent such as a polyhydroxybenzene as described in JP O.P.I. No. 3972/1974; the aqueous latex Subbing layer as described in JP O.P.I. Nos. 11118/1974, 104913/1977, 19941/1984, 19940/1984, 18945/1984, 112326/1976, 117617/1976, 58469/1976, 114120/1976, 121323/1976, 123139/1976, 114121/1976, 139320/1977, 119919/1977, 65422/1977, 109923/1977, 119919/1977, 65949/1980, 128332/1982 and 19941/1984: and the vinilidene-chloride subbing layer described in U.S. Pat. Nos. 2,698,235, 2,779,684, 4,254,210 and 4,645,731. The subbing layer may be subjected to a chemical or physical surface-activation treatment, such as a treatment with chemicals, mechanical treatment, corona-discharge treatment, flame treatment, UV treatment, high-frequency treatment, glow-discharge treatment, active-plasma treatment, laser treatment, mixed-acid treatment and ozone-oxidation treatment. The subbing layer is distinguished from the coated layers in the invention, and the coating time and conditions of the subbing layer are subjected to no restrictions.

Where the invention is applied to a silver halide photographic light-sensitive material, no restrictions are imposed on the use of ordinary additives and contrast-increasing agents, the preparation and sensitization of silver halide grains, and the like, for which reference can be made to JP O.P.I. Nos. 230035/1988 and 266640/1989.

In the invention, at least one antistatic layer may be provided on the backing side and/or the emulsion layer side of the support.

In this instance the surface resistivity on the antistatic layer side of the support is preferably not more than $1.0\times10^{11}\Omega$, and more preferably not more than $8\times10^{11}\Omega$ at 25° C./50% RH.

The above antistatic layer is preferably one containing a water-soluble conductive polymer, hydrophobic polymer and reaction product of a hardener.

The above water-soluble conductive polymer is a polymer having at least one conductive group selected from the class consisting of a sulfonic acid group, sulfate group, quaternary ammonium base, tertiary ammonium base, carboxyl group and polyethylene-oxide group. The preferred among these are the sulfonic acid group, sulfate group and quaternary ammonium base. The conductive group is required to account for not less than 5% by weight per molecule of the water-soluble conductive polymer. The water-soluble conductive polymer contains groups such as a carboxyl group, hydroxy group, amino group, epoxy group. aziridine group, active methylene group, sulfinic acid group. aldehyde group, vinylsulfon group, and the like. Of these groups, the water-soluble conductive polymer preferably contains the carboxyl, hydroxy, amino, epoxy, aziridine and aldehyde groups. These groups need to be contained in an amount of not less than 5% by weight per mol of the polymer. The number average molecular weight of the water-soluble conductive polymer is preferably 3000 to 100000, and more preferably 3500 to 50000.

As the above metal oxide there may be suitably used tin oxide, indium oxide, antimony oxide, zinc oxide or those obtained by doping these oxides with metallic phosphorus or metallic indium. The average particle size of these metal oxides is preferably 1μ to 0.01μ.

The invention is applicable to general plastic films, coat paper, and silver halide photographic light-sensitive materials such as graphic arts films, X-ray films, negative films for general use, reversal films for general used, positive films for general use, and various light-sensitive materials (including photographic papers) for direct positive use. Particularly when applied to light-sensitive materials for graphic arts use the invention scarcely causes pinhole trouble even if the amount of gelatin is reduced, so that it is effective to improve its dimensional stability (hygroscopic expansion property).

EXAMPLES

Example 1

Preparation of Matting Agent Particles

Amorphous silica having an average particle size of 4μm. produced by Fuji Devison co.; amorphous spherical polymethyl methacrylate (PMMA) having an average particle size of 5μm, MBP produced by Sekisui Kaseihin Kogyo K. K.; or amorphous spherical polystyrene having an average particle size of 8μ, SBP, produced by Sekisui Kaseihin Kogyo K. K., was used as matting agent nuclei to perform repellent material coatings in accordance with the following production method A and production method B as shown in the following Table 1.

Production Method A

A water-repellent material was vacuum deposited on the surface of the amorphous silica by use of a vacuum deposition device HSV-8-50, manufactured by Sato Shinku-Kikai Kogyo Co.

Production Method B

A water-repellent material coat was formed on the surface of matting agent particles by use of a particle surface reforming device, manufactured by Nara Kikai-Seisakusho Ltd.

TABLE 1

| Matting agent No. | Matting agent nucleus | Water-repellent material | Production method |
|---|---|---|---|
| I-1 (Inv.) | Silica | Dichloromethylsilane | A |
| I-2 (Inv.) | Silica | Trimethylfluorosilane | A |
| I-3 (Inv.) | Silica | Dimethyl silicone oil | A |
| I-4 (Inv.) | Silica | Ethylene tetrafluoride | A |
| II-1 (Inv.) | Silica | Dichlorodimethylsilane | B |
| II-2 (Inv.) | Silica | Trimethylfluorosilane | B |
| II-3 (Inv.) | Silica | Dimethyl silicone oil | B |
| II-4 (Inv.) | Silica | Ethylene tetrafluoride | B |
| III-1 (Inv.) | PMMA | Dichloromethylsilane | A |
| III-2 (Inv.) | PMMA | Trimethylfluorosilane | A |
| III-3 (Inv.) | PMMA | Dimethyl silicone oil | A |
| III-4 (Inv.) | PMMA | Ethylene tetrafluoride | A |
| IV-1 (Inv.) | PMMA | Dichlorodimethylsilane | B |
| IV-2 (Inv.) | Polystyrene | Trimethylfluorosilane | B |
| IV-3 (Inv.) | PMMA | Dimethyl silicone oil | B |
| IV-4 (Inv.) | PMMA | Ethylene tetrafluoride | B |
| V-1 (Comp.) | Silica | None | |
| V-2 (Comp.) | PMMA | None | |

Preparation of Samples

A 100μm-thick polyethylene terephthalate base, having a subbing layer as disclosed in JP O.P.I. No. 19941/1984, with its surface subjected to $10W/m^3$ min corona discharge treatment, was coated thereon with a coating liquid prepared by incorporating sodium dodecylbenzenesulfonate and the above matting agents I-1 through V-2 into a 5% aqueous gelatin solution and applying ultrasonic-dispersion so as to have a matting agent coating weight of $20mg/m^2$ and a gelatin coating weight of $1g/m^2$, whereby Samples No. 1 to No. 18 were obtained.

Smoothter Value

The smoothter value of each sample was measured as the barometer of its mattedness. After each sample was allowed to stand in an atmosphere of 23° C/48%RH, the measurement was conducted under the same atmospheric conditions with use of a measuring instrument SM-6B, manufactured by Toei Electronic Industry Co., in accordance with the paper pulp testing method No. 5 specified by J. TAPPI.

Blocking Property

A 250 cm×10 m size sheet of each sample was wound around a 75 mm-diameter core (150 $kg/cm^2$ in gross) and allowed to stand at 23° C./80%RH for 7 days, and then its blocking degree was evaluated as follows:

Rank 5: No blocking is observed at all.

Rank 4: A little blocking is found when the sheet is peeled apart, but no marks remain after peeling.

Rank 3: Blocking is observed when peeling, and some marks thereof remain.

Rank 2: Blocking occurs when peeling. After peeling, the delamination of the gelatin layer or subbing layer is found.

Rank 1: Strong blocking occurs when peeling. and the support is found torn.

The results are shown in Table 2.

TABLE 2

| Sample No. | Matting agent No. | Smoothter value (mmHg) | Blocking |
|---|---|---|---|
| 1 (Inv.) | I-1 | 82 | 5 |
| 2 (Inv.) | I-2 | 79 | 5 |
| 3 (Inv.) | I-3 | 86 | 5 |
| 4 (Inv.) | I-4 | 81 | 5 |
| 5 (Inv.) | II-1 | 74 | 4 |
| 6 (Inv.) | II-2 | 79 | 5 |
| 7 (Inv.) | II-3 | 89 | 5 |
| 8 (Inv.) | II-4 | 71 | 4 |
| 9 (Inv.) | III-1 | 73 | 5 |
| 10 (Inv.) | III-2 | 74 | 5 |
| 11 (Inv.) | III-3 | 80 | 5 |
| 12 (Inv.) | III-4 | 75 | 5 |
| 13 (Inv.) | IV-1 | 76 | 5 |
| 14 (Inv. | IV-2 | 74 | 4 |
| 15 (Inv.) | IV-3 | 88 | 5 |
| 16 (Inv.) | IV-4 | 75 | 5 |
| 17 (Comp.) | V-1 | 25 | 2 |
| 18 (Comp.) | V-2 | 38 | 2 |

As is apparent from Table 2, the samples of the invention are excellent in the mattedness as well as in the antiblocking ability.

Example 2

Silver halide light-sensitive material Samples No. 19 to No. 24 were prepared as follows:

An emulsion layer containing 100% silver chloride cubic grains having an average grain size of 0.15 μm and $5\times10^{-5}$ mol/mol of Ag of rhodium chloride complex was coated on a support so as to have a silver coating weight of 3.5 g/m$^2$ and a gelatin coating weight of 2g/m$^2$. On the above emulsion layer was then coated a protective layer containing the foregoing matting agent I-2, IV-4 or V-1 so as to have a gelatin coating weight of 1 g/m$^2$, provided that the coating weights of the matting agents are shown in Table 3.

Pinholes Caused By Matting Agent

The emulsion plane of each sample was contacted with a 100 μ-thick polyester film, and the resulting material was uniformly over-all exposed so as to give a density of 2.0, then processed, and then examined visually, wherein the exposure was made by use of a printer P-627FM, manufactured by DaiNippon Screen Co., and the processing was made for 30 seconds at 28° C. in an automatic processor GR-27, manufactured by KONICA Corp.

The pinhole defects were ranked as follows:

Rank 5: Few or no pinholes are found even when the sample is placed on a light table to observe through a ten-power power magnifier, excluding outside light.

Rank 4: Almost no pinholes are observed visually, although some are found through a 10-power magnifier.

Rank 3: The presence of pinholes is recognized with the naked eye, but acceptable for practical use.

Rank 2: The presence of pinholes is discernible even with the naked eye; the transmission density is lowered.

Rank 1: Pinholes appear throughout the area; unacceptable. Those ranked 2 and 1 can not be used at all.

TABLE 3

| Sample No. | Matting agent No. | Added amt (mg/m$^2$) | Smoothter value (mmHg) | Pinhole rank |
|---|---|---|---|---|
| 19 (Inv.) | I-2 | 5 | 20 | 5 |

TABLE 3-continued

| Sample No. | Matting agent No. | Added amt (mg/m$^2$) | Smoothter value (mmHg) | Pinhole rank |
|---|---|---|---|---|
| 20 (Inv.) | I-2 | 20 | 79 | 4 |
| 21 (Inv.) | I-2 | 50 | 96 | 3 |
| 22 (Inv.) | IV-4 | 5 | 18 | 5 |
| 23 (Inv.) | IV-4 | 20 | 64 | 4 |
| 24 (Inv.) | IV-4 | 50 | 89 | 3 |
| 25 (Comp.) | V-1 | 5 | 5 | 3 |
| 26 (Comp.) | V-1 | 20 | 25 | 2 |
| 27 (Comp.) | V-1 | 50 | 50 | 1 |

As is apparent from Table 3, the samples of the invention show much better smoothter values and pinhole ranks than the comparative samples.

Example 3

Tests were made in the same manner as in Example 2 except that the silver halide emulsion of Example 2 was replaced by a positive-type emulsion having an optimal sensitivity for contact printing exposure to a quartz lamp light, and the sample remaining unexposed was processed. The results are shown in Table 4.

TABLE 4

| Sample No. | Matting agent No. | Added amt (mg/m$^2$) | Smoothter value (mmHg) | Pinhole rank |
|---|---|---|---|---|
| 28 (Inv.) | I-2 | 5 | 20 | 4 |
| 29 (Inv.) | I-2 | 20 | 79 | 3 |
| 30 (Inv.) | I-2 | 50 | 96 | 3 |
| 31 (Inv.) | IV-4 | 5 | 18 | 4 |
| 32 (Inv.) | IV-4 | 20 | 64 | 4 |
| 33 (Inv.) | IV-4 | 50 | 89 | 3 |
| 34 (Comp.) | V-1 | 5 | 5 | 2 |
| 35 (Comp.) | V-1 | 20 | 25 | 2 |
| 36 (Comp.) | V-1 | 50 | 50 | 1 |

Example 4

Samples were prepared in the same manner as in Example 2 except that the gelatin coating weight of the protective layer was changed to 0.5 g/m$^2$ and that of the emulsion layer to 1.0 g/m$^2$, and the smoothter values measurement and pinhole defects evaluation were performed in the same manner as in Example 2. In addition, the changes in the hygroscopic expansion of the samples in comparison with those of Example 2 were measured in accordance with the following method. The results are shown in Table 5.

Change in Hygroscopic Expansion

Each sample was cut into a 60 cm×5 cm-size piece, and on it was put a mark at a distance of 56 cm from one end. This piece was allowed to stand over a period of 5 hours under an atmospheric condition of 23° C./20%RH, and then the difference between the marked distance on the piece and the reference distance of 56 cm graduated on a 5 mm-thick glass plate was read. Next, the sample was further allowed to stand in a 23° C./55%RH environment for 5 hours, and the difference was read in the same way. The difference between both readings obtained above was regarded as the hygroscopic expansion value of each sample.

TABLE 5

| Sample No. | Matting agent No. | Added amt (mg/m$^2$) | Smoothter value | Hygroscopic exp.val. (μm) | Pinhole rank |
|---|---|---|---|---|---|
| 37 (Inv.) | I-2 | 5 | 30 | 195 | 4 |

TABLE 5-continued

| Sample No. | Matting agent No. | Added amt (mg/m²) | Smoothter value | Hygroscopic exp.val. (μm) | Pinhole rank |
|---|---|---|---|---|---|
| 38 (Inv.) | I-2 | 20 | 89 | 187 | 3 |
| 39 (Inv.) | IV-4 | 5 | 34 | 179 | 4 |
| 40 (Inv.) | IV 4 | 20 | 86 | 178 | 4 |
| 41 (Comp.) | V-1 | 5 | 13 | 186 | 1 |
| 42 (Comp.) | V-1 | 20 | 45 | 180 | 1 |
| 19 (Inv.) | I-2 | 5 | 20 | 256 | 5 |
| 20 (Inv.) | I-2 | 20 | 79 | 259 | 4 |
| 22 (Inv.) | IV-4 | 5 | 18 | 264 | 5 |
| 23 (Inv.) | IV-4 | 20 | 64 | 269 | 4 |
| 25 (Comp.) | V-1 | 5 | 5 | 256 | 3 |
| 26 (Comp.) | V-1 | 20 | 25 | 276 | 2 |

As is apparent from Table 5, the samples of the invention show less pinhole defects and better improved hygroscoptic expansion property than those of the comparative samples.

Example 5

Samples were prepared in the same manner as in Example 1 except that the support of the samples in Example 1 was replaced by polyethylene-laminated paper support. Tests and evaluation were performed in the same manner as in Example 1. The results are shown in Table 6.

TABLE 6

| Sample No. | Matting agent No. | Smoothter value (mmHg) | Blocking |
|---|---|---|---|
| 43 (Inv.) | I-1 | 83 | 5 |
| 44 (Inv.) | I-2 | 74 | 5 |
| 45 (Inv.) | I-3 | 93 | 5 |
| 46 (Inv.) | I-4 | 85 | 5 |
| 47 (Inv.) | II-1 | 72 | 4 |
| 48 (Inv.) | II-2 | 82 | 5 |
| 49 (Inv.) | II-3 | 79 | 5 |
| 50 (Inv.) | II-4 | 77 | 4 |
| 51 (Inv.) | III-1 | 83 | 5 |
| 52 (Inv.) | III-2 | 84 | 5 |
| 53 (Inv.) | III-3 | 75 | 5 |
| 54 (Inv.) | III-3 | 78 | 5 |
| 55 (Inv.) | IV-1 | 76 | 5 |
| 56 (Inv.) | IV-2 | 86 | 4 |
| 57 (Inv.) | IV-3 | 91 | 5 |
| 58 (Inv.) | IV-4 | 78 | 5 |
| 59 (Comp.) | V-1 | 19 | 2 |
| 60 (Comp.) | V-2 | 36 | 2 |

As is apparent from Table 6, similar results to those of Example 1 are obtained.

Example 6

Preparation of Matting Agent Particles

Amorphous silica having an average particle size of 7μ, produced by Fuji Davison Co., was used as matting agent nuclei, and on the surface thereof was coated a silane coupling agent in accordance with the following method a and method b as shown in Table 7. In addition, polymethyl methacrylate (PMMA) spherical particles having an average particle size of 5 μ were used, and on the surface thereof was coated a silane coupling agent in accordance with the following method c as shown in Table 7.

Preparation of Aqueous Silane Coupling Agent Solution

A threefold-diluted silane coupling agent methanol solution was added to water so as to make its silane coupling agent content 4%, and the solution with its pH adjusted to 3.5 was stirred for 15 minutes.

Method A

The above aqueous silane coupling agent solution was sprayed onto the surface of the matting agent.

Method B

A ultrasonic dispersion of 10g of the matting agent in 100 ml of water was rapidly stirred at a rate of 5000 rpm to be slurried, and to the slurry was added the above silane coupling agent solution so as to have a proportion of 50% to the matting agent, and the mixture was stirred for 30 minutes. This liquid was allowed to stand until the solid matter settled, and the supernatant was decanted off to separate the residuum, which was then dried under vacuum.

Method C

To the slurry dispersion containing 10% PMMA particles was added 0.4% silane coupling agent, the mixture was dispersed for 30 minutes, and then the liquid was dried under vacuum.

TABLE 7

| Matting agent No. | Matting nuclei | Silane coupling agent | Method |
|---|---|---|---|
| I-1 (Inv.) | Silica | A-2 | a |
| 2 (Inv.) | " | A-8 | a |
| 3 (Inv.) | " | A-11 | a |
| 4 (Inv.) | " | A-14 | a |
| II-1 (Inv.) | " | A-2 | b |
| 2 (Inv.) | " | A-8 | b |
| 3 (Inv.) | " | A-11 | b |
| 4 (Inv.) | " | A-14 | b |
| III-1 (Inv.) | PMMA | A-15 | c |
| 2 (Inv.) | " | A-16 | c |
| 3 (Inv.) | " | A-17 | c |
| 4 (Inv.) | " | A-18 | c |
| IV-1 (Comp.) | Silica | None | |
| 2 (Comp.) | PMMA | None | |

Preparation of Samples

A 100μ-thick polyethylene terephthalate film support, having a subbing layer described in JP O.P.I. No. 19941/1984, with its subbed surface subjected to 10 W/m².min corona discharge treatment, was coated thereon with a coating liquid prepared by incorporating sodium dodecylbenzenesulfonate and the above matting agents I-2 to IV-2 into a aqueous gelatin solution and applying ultrasonic-dispersion so as to have a matting agent coating weight of 20mg/m² and a gelatin coating weight of 1g/m².

In the same manner as in Example 1, the smoothter value and blocking property of each sample were measured.

Further, each sample was cut into 610 mm×508mm-size sheets, a set of 100 sheets was put in a paper bag, and 3 bags of 100 sheets were prepared and piled up on a table. One sheet was pulled out of the middle of the pile in the lowest bag, and measured for its smoothter value, which was compared with that of one picked out of non-piled sheets. The results are shown in Table 8.

TABLE 8

| Sample No. | Smoothter value (mmHg) | Smoothter value after pullout(mmHg) | Blocking |
|---|---|---|---|
| 1 (Inv.) | 92 | 92 | 5 |
| 2 (Inv.) | 89 | 88 | 5 |
| 3 (Inv.) | 87 | 85 | 5 |

TABLE 8-continued

| Sample No. | Smoothter value (mmHg) | Smoothter value after pullout(mmHg) | Blocking |
|---|---|---|---|
| 4 (Inv.) | 90 | 89 | 5 |
| 5 (Inv.) | 80 | 80 | 5 |
| 6 (Inv.) | 76 | 75 | 4 |
| 7 (Inv.) | 79 | 77 | 5 |
| 8 (Inv.) | 77 | 76 | 4 |
| 9 (Inv.) | 76 | 76 | 5 |
| 10 (Inv.) | 74 | 74 | 5 |
| 11 (Inv.) | 72 | 71 | 4 |
| 12 (Inv.) | 76 | 74 | 4 |
| 13 (Comp.) | 29 | 15 | 2 |
| 14 (Comp.) | 41 | 25 | 2 |

From Table 8 it is understood that the samples of the invention show much better mattedness and antiblocking property than the comparative samples.

Example 7

Silver halide light-sensitive material Samples No. 15 to No. 26 were prepared as follows:

An emulsion layer of silver halide cubic grains having an average grain size of 0.18μ, comprising 98% silver chloride and 2% silver bromide and $4\times10^{-5}$ mol/mol Ag of rhodium chloride complex was coated on a support so as to have a silver coating weight of 3.5 g/m$^2$ and a gelatin coating weight of 2.0g/m$^2$.

On the above emulsion layer was coated a protective layer containing the above matting agent I-2, II-3, III-4 or IV-1 so as to have a gelatin coating weight of 1.1 g/m$^2$, provided that the coating weights of the matting agents are as shown in Table 9.

Pinhole Defects Cause By Matting Agent

The emulsion plane of each sample was contacted with a 100μ-thick polyester film, and the resulting material was uniformly over-all exposed by use of a printer P-627F, manufactured by Dai-Nippon Screen Co., so as to give a density of 2.0, and then processed for visual examination of pinhole defects. The exposed sample was processed at 28° C. for 30 seconds in a developer CDM-651K with an autoprocessor GR-27, both manufactured by KONICA Corp.

Those having pinhole defects ranked 2 and 1 are unacceptable for practical use.

TABLE 9

| Sample No. | Matting agent | Added amt (mg/m$^2$) | Smoothter value(mmHg) | Pinhole rank |
|---|---|---|---|---|
| 15 (Inv.) | I-1 | 5 | 25 | 5 |
| 16 (Inv.) | | 20 | 83 | 4 |
| 17 (Inv.) | | 50 | 108 | 4 |
| 18 (Inv.) | II-3 | 5 | 19 | 5 |
| 19 (Inv.) | | 20 | 77 | 4 |
| 20 (Inv.) | | 50 | 102 | 4 |
| 21 (Inv.) | III-4 | 5 | 16 | 5 |
| 22 (Inv.) | | 20 | 75 | 5 |
| 23 (Inv.) | | 50 | 100 | 4 |
| 24 (Comp.) | IV-1 | 5 | 4 | 2 |
| 25 (Comp.) | | 20 | 26 | 1 |
| 26 (Comp.) | | 50 | 52 | 1 |

As is apparent from Table 9, the samples of the invention have much better smoothter values and less pinhole defects than the comparative samples.

Example 8

Samples were prepared in the same manner as in Example 7 except that the adding amount of the rhodium chloride complex was changed to 1 g/mol Ag and the silver halide emulsion was replaced by a positive-type emulsion having an optimal sensitivity for contact printing exposure to a quarts lamp light. Tests were made in the same manner as in Example 7 except that the samples were unexposed. The results are shown in Table 10.

TABLE 10

| Sample No. | Matting agent | Added amt (mg/m$^2$) | Smoothter value(mmHg) | Pinhole rank |
|---|---|---|---|---|
| 27 (Inv.) | I-1 | 5 | 23 | 5 |
| 28 (Inv.) | | 20 | 81 | 5 |
| 29 (Inv.) | | 50 | 105 | 4 |
| 30 (Inv.) | II-3 | 5 | 17 | 5 |
| 31 (Inv.) | | 20 | 74 | 5 |
| 32 (Inv.) | | 50 | 100 | 4 |
| 33 (Inv.) | III-4 | 5 | 15 | 5 |
| 34 (Inv.) | | 20 | 73 | 4 |
| 35 (Inv.) | | 50 | 98 | 4 |
| 36 (Comp.) | IV-1 | 5 | 5 | 2 |
| 37 (Comp.) | | 20 | 27 | 1 |
| 38 | | 50 | 54 | 1 |

Example 9

Samples were prepared in the same manner as in Example 7 except that the gelatin coating weight of the protective layer was changed to 0.5 g/m$^2$ and that of the emulsion layer to 1.0 g/m$^2$, and tests were performed in the same manner as in Example 7. For the hygroscopic expansion property, the samples of Example 7 corresponding to the samples of Example 9 were measured as well for comparison.

Change in Hygroscopic Expansion

Each sample was cut into a 60 cm×5 cm-size piece, and on it was put a mark at a distance of 56 cm from one end. This piece was allowed to stand for 5 hours under an atmospheric condition of 23° C./20%RH, and then the difference between the marked distance on the piece and the reference distance of 56 cm graduated on a 5 mm-thick glass plate is read. Next, the sample was allowed to stand for 5 hours in a 23° C./55%RH environment, and then the difference was read in the same way. The difference between both readings obtained above was regarded as the hygroscopic expansion value of each sample.

TABLE 11

| Sample No. | Matting agent | Added amt (mg/m$^2$) | Smoothter val. (mmHg) | Hygroscopic exp.value (μ)* | Pinhole rank |
|---|---|---|---|---|---|
| 39 (Inv.) | I-1 | 5 | 25 | 187 | 5 |
| 40 (Inv.) | | 20 | 83 | 180 | 4 |
| 41 (Inv.) | II-3 | 5 | 21 | 183 | 4 |
| 42 (Inv.) | | 20 | 80 | 175 | 4 |
| 43 (Inv.) | III-4 | 5 | 19 | 185 | 4 |
| 44 (Inv.) | | 20 | 80 | 178 | 4 |
| 45 (Comp.) | IV-1 | 5 | 13 | 186 | 1 |
| 46 (Comp.) | | 20 | 45 | 180 | 1 |
| 15 (Inv.) | I-1 | 5 | 18 | 268 | 5 |
| 16 (Inv.) | | 20 | 76 | 263 | 4 |
| 18 (Inv.) | II-3 | 5 | 14 | 266 | 5 |
| 19 (Inv.) | | 20 | 71 | 264 | 4 |
| 21 (Inv.) | III-4 | 5 | 12 | 270 | 5 |
| 22 (Inv.) | | 20 | 70 | 266 | 4 |
| 24 (Comp.) | IV-1 | 5 | 5 | 256 | 3 |
| 25 (Comp.) | | 20 | 25 | 276 | 2 |

*per 56 cm

As is apparent from Table 11, the samples of the invention show less pinhole defects and much better improved hygroscopic expansion property than the comparative samples.

Example 10

Samples were prepared in the same manner as in Example 6 except that the support was replaced by a polyolefin-laminated paper support, and the samples were tested for evaluation in the same manner as in Example 6. The results are shown in Table 12.

TABLE 12

| Sample No. | Smoothter value (mmHg) | Smoothter value after pullout(mmHg) | Blocking |
|---|---|---|---|
| 47 (Inv.) | 94 | 93 | 5 |
| 48 (Inv.) | 90 | 88 | 5 |
| 49 (Inv.) | 88 | 86 | 5 |
| 50 (Inv.) | 91 | 89 | 5 |
| 51 (Inv.) | 80 | 80 | 5 |
| 52 (Inv.) | 79 | 77 | 4 |
| 53 (Inv.) | 82 | 81 | 5 |
| 54 (Inv.) | 79 | 78 | 4 |
| 55 (Inv.) | 77 | 76 | 5 |
| 56 (Inv.) | 77 | 75 | 5 |
| 57 (Inv.) | 75 | 73 | 4 |

TABLE 12-continued

| Sample No. | Smoothter value (mmHg) | Smoothter value after pullout(mmHg) | Blocking |
|---|---|---|---|
| 58 (Inv.) | 78 | 78 | 4 |
| 59 (Comp.) | 30 | 16 | 2 |
| 60 (Comp.) | 42 | 27 | 2 |

As is apparent from Table 12, the samples of the invention show as good results as in Example 6.

What is claimed is:

1. A silver halide photographic light-sensitive material comprising a support and provided thereon, a silver halide emulsion layer and a hydrophilic colloidal layer comprising particles with an average particles size of 0.5 to 20 $\mu$ coated with a silane coupling agent in that order, wherein said particles are composed of amorphous silica or polymethylmethacrylate and contained in an amount of 1 to 150 mg/m$^2$.

2. The material of claim 1, wherein said hydrophilic colloid is gelatin.

3. The material of claim 1, wherein said silane coupling agent is selected from N-($\beta$-aminoethyl)-$\gamma$-aminopropyltrimethoxysilane, $\gamma$-glycidoxypropoyltrimethoxy-silane and di-($\gamma$-glycidoxypropyl)dimethoxysilane.

* * * * *

UNITED STATES PATENT AND TRADEMARK OFFICE

CERTIFICATE OF CORRECTION

PATENT NO. : 5,204,233

DATED : April 20, 1993

INVENTOR(S) : Akira Ogasawara et al.

It is certified that error appears in the above-indentified patent and that said Letters Patent is hereby corrected as shown below:

Claim 1, column 14, line 15, change "particles" (second occurence) to --particle--.

Claim 3, column 14, line 24, change "glycidoxypropoyltrime-" to --glycidoxypropyltrime--.

Signed and Sealed this

Fifteenth Day of March, 1994

*Attest:*

*Attesting Officer*

BRUCE LEHMAN

*Commissioner of Patents and Trademarks*